US006561933B1

(12) United States Patent
Hsu

(10) Patent No.: US 6,561,933 B1
(45) Date of Patent: May 13, 2003

(54) SHOCKPROOF DEVICE IN THE THROAT OF A TENNIS RACKET

(76) Inventor: Henry Hsu, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 10/000,164

(22) Filed: Dec. 4, 2001

Related U.S. Application Data

(63) Continuation-in-part of application No. 09/987,783, filed on Nov. 16, 2001.

(51) Int. Cl.[7] ..... A63B 49/02
(52) U.S. Cl. ..... 473/521; 473/522; 473/546
(58) Field of Search ..... 473/520, 521, 473/522, 546, 531, 535, 524

(56) References Cited

U.S. PATENT DOCUMENTS 4,765,620 A * 8/1988 Janes ..... 473/521
4,828,260 A * 5/1989 Todd ..... 473/521
4,889,338 A * 12/1989 Keijiro ..... 473/546
5,350,173 A * 9/1994 DiCerbo ..... 473/521
5,779,572 A * 7/1998 Dicerbo ..... 473/521

FOREIGN PATENT DOCUMENTS

| | | | |
|---|---|---|---|
| DE | 605166 | * 11/1934 | ..... 473/FOR 181 |
| EP | 221688 | * 5/1987 | ..... 473/FOR 181 |
| GB | 420966 | * 12/1934 | ..... 473/FOR 181 |

* cited by examiner

*Primary Examiner*—Raleigh W. Chiu

(57) ABSTRACT

A shockproof device in the throat of a tennis racket includes a racket having a frame, a stringing surface in the frame, a throat of truncated triangular configuration under the frame and including a pair of tubular branches spacedly extending downward from the lower peripheries of the frame and a Y-shaped handle including a pair of solid branches spacedly extending upward and each having an elastic sleeve wrapped on inserted into the tubular branches in a predetermined depth and secured by adhesives, and a conical gap centrally formed in the bottom of the frame and filled up by an conical elastic projection of a sheath which wraps the frame. Thereby, the shock waves from the frame are partially hindered and absorbed by the conical elastic projection and partially absorbed by the elastic sleeves in the throat without transmitting to the handle.

6 Claims, 4 Drawing Sheets

SHOCKPROOF DEVICE IN THE THROAT OF A TENNIS RACKET

This application is a continuation-in-part of application Ser. No. 09/987,783, filed Nov. 16, 2001.

BACKGROUND OF THE INVENTION

The present invention relates to tennis racket and more particularly to a shockproof device in the throat of a tennis racket which absorbs the shock waves from the frame without transmitting to the handle of the racket.

The shockproof device in a tennis racket is very important. It prevents the shock waves from transmitting to the handle of a racket in order to protect the hand of a player and to promote the scores of the player in a competition. Generally, a hit of a tennis racket against a flying ball creates a great deal of the shock waves. If the tennis racket has no any shockproof arrangement. The shock waves will transmit to the handle of the racket that injure the hand and twist of the player and gradually cause a tennis elbow. Thus, many tennis rackets in the market have different shockproof devices. However, the result is not as expected.

SUMMARY OF THE PRESENT INVENTION

The present invention has a main object to provide a shockproof device in the throat of a tennis racket to prevent the shock waves from transmitted to the handle of the racket.

Accordingly, the shockproof device in the throat of a tennis racket of the present invention comprises generally a racket having a head or frame, a stringing surface in the frame, a throat separated from a handle to form a truncated triangular configuration which has a pair of tubular branches spacedly extended downward from the frame. The handle forms a Y-shaped configuration which has a pair of branches spacedly extended upward from the handle and respectively inserted into the tubular branches of the throat in predetermined depth. An elastic sleeve is wrapped on the branches of the handle and secured by adhesives. A conical gap centrally formed in the bottom of the frame and to set the bottom of the frame apart. A sheath has a conical elastic projection centrally formed on inner surface to fill up the gap of the frame and a plurality of tubular pins spacedly projected from inner surface of the sheath to respectively insert into the horizontal string holes of the frame for permitting the strings passing through. Therefore, the shock waves will be absorbed by the sheath and the throat without transmitting to the handle.

The present invention will become more fully understood by reference to the following detailed description thereof when read in conjunction with the attached drawings.

DETAILED DESCRIPTION OF THE PREFERRED EMBODIMENT

Figure 1:
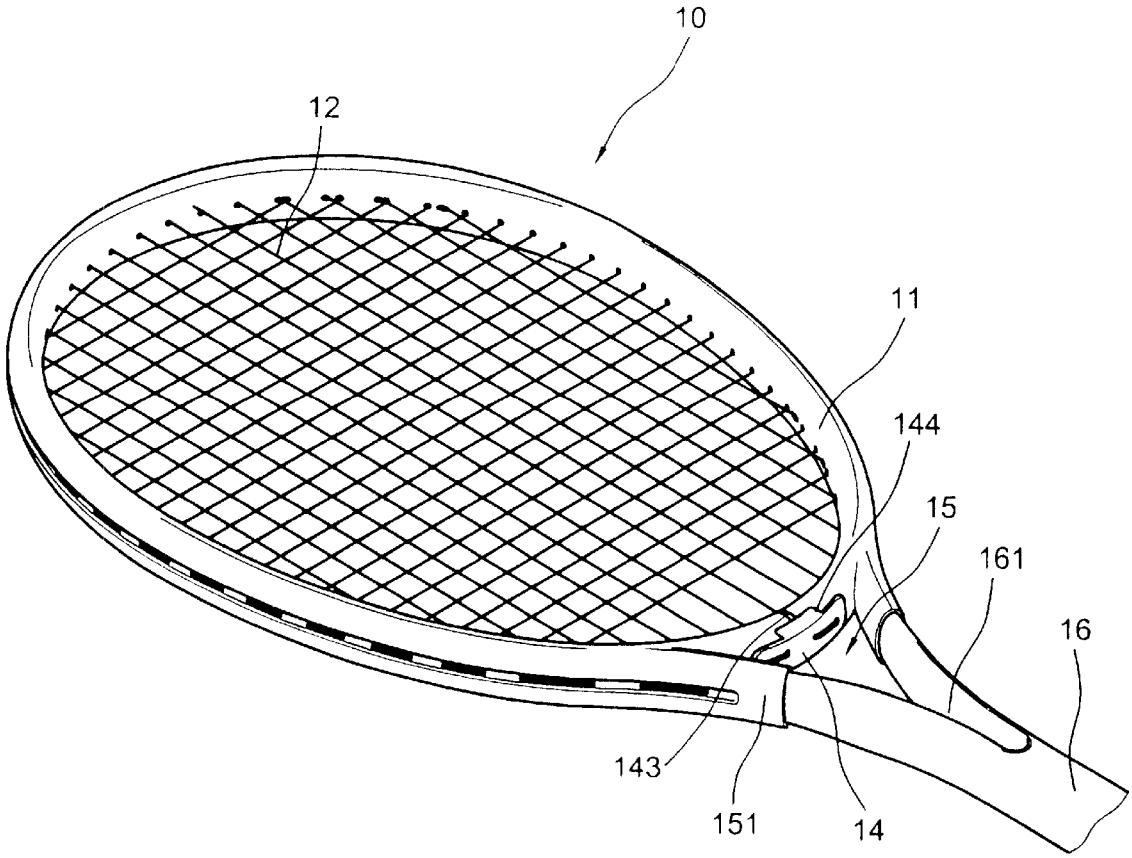
FIG. 1 is a perspective view to show a tennis racket of a preferred embodiment of the present invention.
Figure 2:
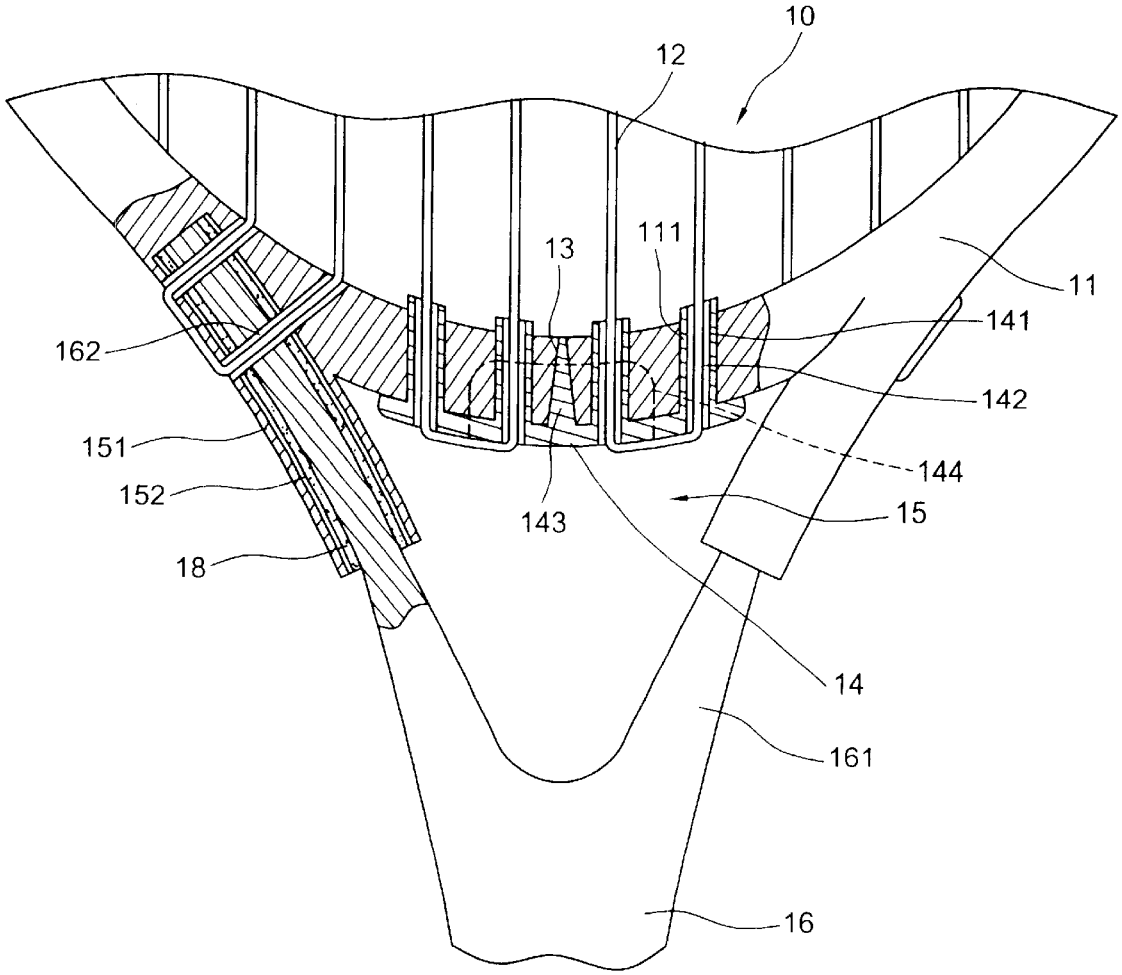
FIG. 2 is a sectional view of FIG. 1.
Figure 3:
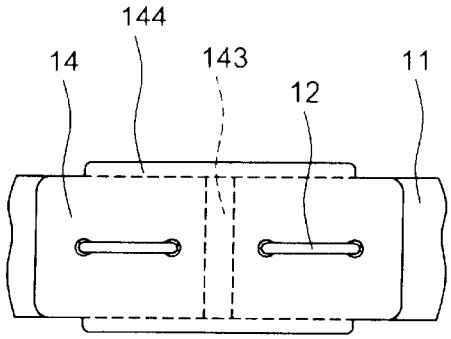
FIG. 3 is a plane view of a sheath of the present invention.

With reference to FIGS. 1, 2 and 3 of the drawings, the first embodiment of the shockproof device in the throat of a tennis racket of the present invention comprises generally a racket 10 having a head or frame 11, a stringing surface 12 inside the frame 11, a conical gap 13 centrally formed in the bottom of the frame 11, a sheath 14 to wrap the bottom of the frame 11 which includes a plurality of tubular pins 141 spacedly extended from the inner surface of the sheath 14 and respectively inserted into the horizontal through holes 111 of the frame 11 for passing through the strings 12, a conical elastic projection 143 centrally projected from an inner surface of the sheath 14 which is provided to fill up the conical gap 13 of the frame 11 and a pair of lateral plates 144 perpendicular to upper and lower edges of the sheath 14 and engaged with the upper and lower surfaces of the frame 11 respectively, a throat 15 separated from the handle 16 so as to form a truncated triangular configuration which includes a pair of tubular branches 151 in predetermined depth, whereas the handle 16 formed a Y-shaped configuration which includes a pair of branches 161 each having an elastic sleeve 18 wrapped on. The branches 161 have the diameter slightly less than the inner diameter 152 of the tubular branches 151 so that the branches 161 with the elastic sleeves 18 wrapped on can be able to insert into the tubular branches 151 in predetermined depth and are secured by adhesives. On the conjunctions of the tubular branches 151 and the frame 11, a plurality of horizontal through holes 162 are formed through the tubular branches 151, the elastic sleeves 18, the branches 161 and the frame 11 in order to permit the strings 12 passing through. These strings 12 have an extra function to fix the tubular branches 151 together with the elastic sleeves 18 and the branches 161. Meanwhile, the strings 12 on the bottom of the frame 11 has also the function to fix the sheath 14 with the frame 11.

Based on the above discussed structure, when the shock waves from the frame 11 are partially hindered and absorbed by the gap 13 and the elastic projection 143 and partially absorbed by the elastic sleeves 18 in the throat 15 without transmitting to the handle 16. So that the hand of a player will feel comfortable when the racket hits a flying ball.

Figure 4:
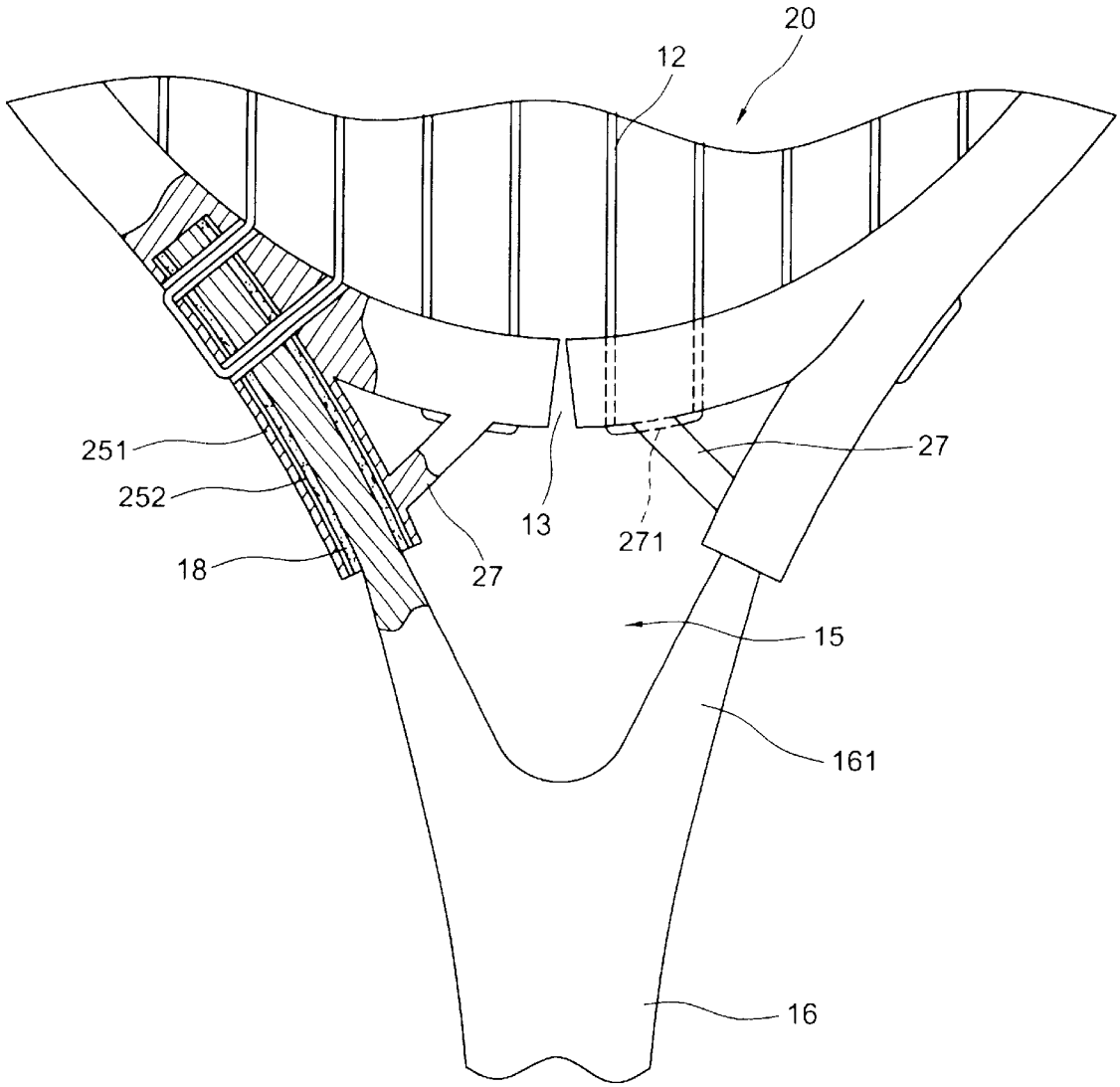
FIG. 4 is a plane view and partially sectional view to show an alternate embodiment of the present invention.

Referring to FIG. 4, a second embodiment of the present invention is provided. In this embodiment the structure and function are mostly similar to the first embodiment as described in FIGS. 1 to 3. The only difference is that the sheath 14 is omitted, and a pair of support rods 27 are added to connect between the bottom of the frame 11 and the tubular branches 151 of the throat 15. Each of the support rods 27 has a horizontal through hole 271 to facilitate the passing through of the string 12. The conical gap 13 still has the function to hinder the shock waves in the frame 11 and the support rods 27 are provided as the reinforcement in the throat 15.

Figure 5:
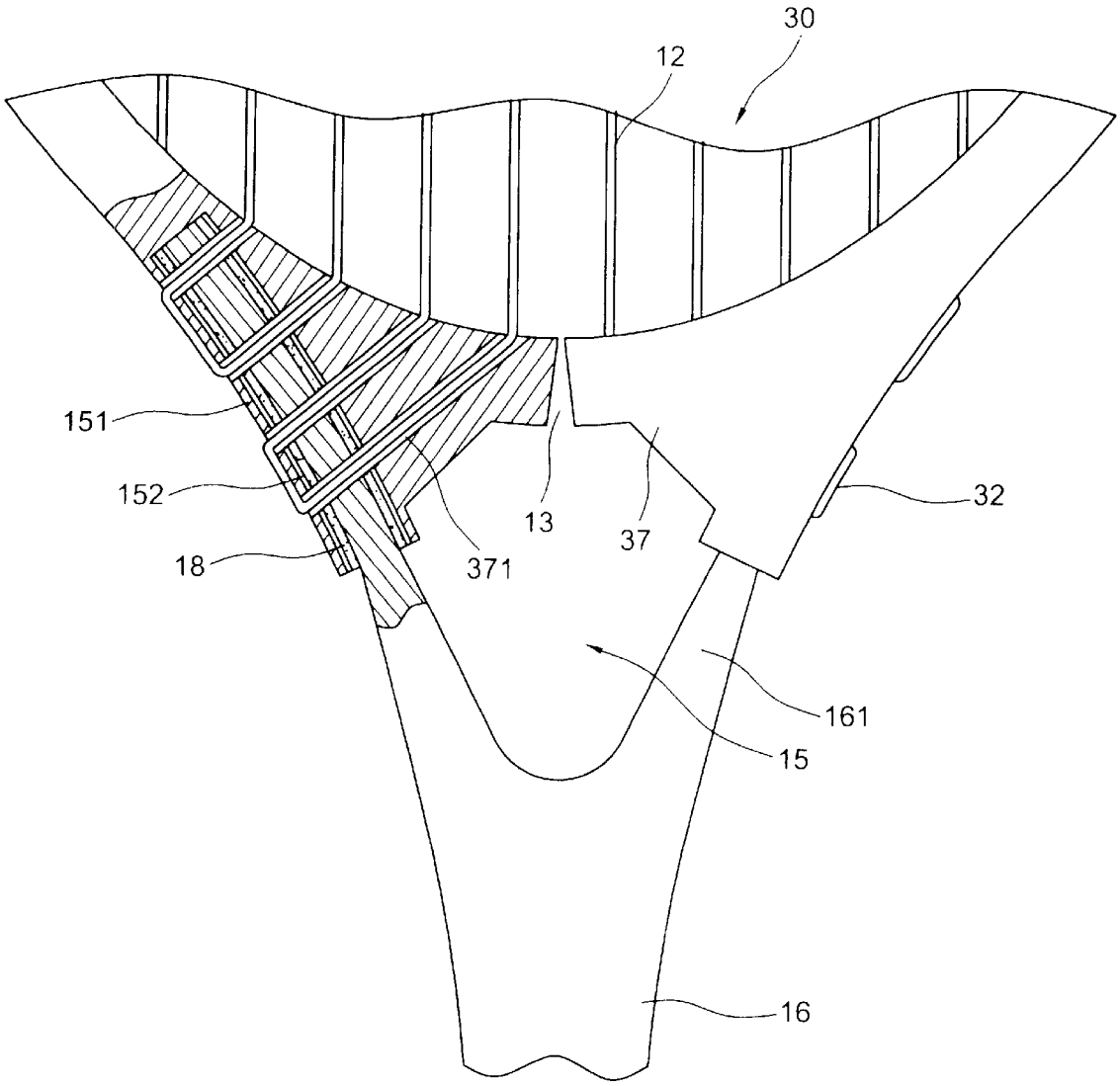
FIG. 5 is a plane view and partially sectional view to show another alternate embodiment of the present invention.

Referring to FIG. 5, a third embodiment of the present invention is provided. The structure and function of this embodiment are principally no difference from the second embodiment. Only the support rods 27 is omitted and instead of is a pair of triangular reinforcement plates 37 integrated with the bottom of the frame 11 and the tubular branches 151 respectively and are positioned at the conjunction of the frame 11 and the tubular branches 151. For the passing through of the strings 12, a plurality of horizontal thru holes 371 are also formed through the tubular branches 151, the elastic sleeves 18, the branches 161, the reinforcement plates 37 and the frame 11.

The specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A shockproof device in the throat of a tennis racket comprising:

a racket having a frame, a stringing surface inside said frame and a conical gap centrally formed in bottom of said frame;

a pair of tubular branches spacedly extending downward from lower peripheries of said frame to define a throat of truncated triangular configuration;

a Y-shaped handle having a pair of branches spacedly extending upward and inserted into said tubular branches respectively in predetermined depth and secured by adhesives;

a pair of elastic sleeves respectively wrapped on the front portion of said branches of said handle inside said tubular branches of said throat;

a plurality of horizontal through holes spacedly formed in conjunctions of said frame and said tubular branches through said tubular branches, said elastic sleeves, said branches of the handle and said frame to permit passing through of strings;

a sheath engaged the bottom of said frame having a conical elastic projection centrally extending upward from a inner surface of said sheath to fill up said conical gap of said frame, a plurality of tubular pins spacedly extending upward to respectively insert into said horizontal through holes of said frame for passing through said strings and a pair of lateral plates engaged with upper and lower surface of said frame;

whereby shockwaves from said frame are partially hindered and absorbed by said conical elastic projection and partially absorbed by said elastic sleeves in said throat.

2. The shockproof device as recited in claim 1 wherein said branches of said handle have an outer diameter slightly less than inner diameter of said tubular branches.

3. A shockproof device in the throat of a tennis racket comprising:

a racket having a frame, a stringing surface inside said frame and a conical gap centrally formed in bottom of said frame;

a pair tubular branches spacedly extending downward from lower peripheries of said frame to define a throat of truncated triangular configuration;

a Y-shaped handle having a pair of branches spacedly extending upward each including an elastic sleeve wrapped on front portion and inserted into said tubular branches in predetermined depth and secured by adhesives;

a plurality of horizontal through holes spacedly formed in conjunctions of said frame and said tubular branches through said tubular branches, said elastic sleeves, said branches of said handle and said frame to permit passing through of strings;

a pair of support rods spacedly connected between said frame and said tubular branches abutting said conjunctions for reinforcement purpose.

4. The shockproof device as recited in claim 3 wherein said branches of said handle have an outer diameter slightly less than inner diameter of said tubular branches.

5. A shockproof device in a throat of a tennis racket comprising:

a racket having a frame, a stringing surface inside said frame and a conical gap centrally formed in bottom of said frame;

a pair of tubular branches spacedly extending downward from lower peripheries of said frame to define a throat of truncated triangular configuration;

a Y-shaped handle having a pair of branches spacedly extending upward each including an elastic sleeve wrapped on front portion and inserted into said tubular branches in predetermined depth and secured by adhesives;

a pair of reinforcement plates respectively integrated with said frame and said tubular branches abutting conjunctions of said frame and said tubular branches;

a plurality of horizontal through holes spacedly formed in said conjunctions through said tubular branches, said elastic sleeves, said branches of said handle, said reinforcement plates and said frame to permit passing through of said strings.

6. The shockproof device as recited in claim 5 wherein said branches of said handle have an outer diameter slightly less than inner diameter of said tubular branches.

* * * * *